US006302558B1

(12) United States Patent
Parks

(10) Patent No.: US 6,302,558 B1
(45) Date of Patent: Oct. 16, 2001

(54) PORTABLE SAFETY DEVICE

(76) Inventor: Robert Parks, 568 Morton Ave., Asheboro, NC (US) 27203

( * ) Notice: Subject to any disclaimer, the term of this patent is extended or adjusted under 35 U.S.C. 154(b) by 0 days.

(21) Appl. No.: 09/429,027

(22) Filed: Oct. 29, 1999

(51) Int. Cl.[7] ..... F21V 21/00

(52) U.S. Cl. ..... 362/184; 362/155; 362/191; 362/249

(58) Field of Search ..... 362/105, 106, 362/800, 249, 184, 185, 186, 190, 191, 155

(56) References Cited

U.S. PATENT DOCUMENTS 4,417,299 * 11/1983 Rupp ..... 362/184
4,891,736 * 1/1990 Gouda .
5,010,454 * 4/1991 Hopper ..... 362/61
5,083,246 * 1/1992 Lambert ..... 362/62
5,386,592 * 2/1995 Checkeroski .
5,412,284 * 5/1995 Moore et al. ..... 315/155
5,463,537 * 10/1995 Trattner et al. ..... 362/103
5,559,680 * 9/1996 Tabanera .
5,585,783 * 12/1996 Hall ..... 340/473
5,676,449 * 10/1997 Newsome .
5,738,431 * 4/1998 Lary .
5,743,621 * 4/1998 Mantha et al. .

* cited by examiner

*Primary Examiner*—Sandra O'Shea
*Assistant Examiner*—John Anthony Ward
(74) *Attorney, Agent, or Firm*—Robert Ryan Morishita; Anderson & Morishita

(57) ABSTRACT

The present invention would be a small plastic enclosure having incorporated circuitry and a series of light emitting diodes (LEDS) covered by a plastic lens. The present invention would be designed so that the lights would blink in a random pattern so as to attract attention at night. In addition, a pair of fastening elements would be attached to the side surfaces of the battery compartment in order to assist in securing the battery compartment to the top of a helmet or hat, if so desired. Each of the fastening elements would also contain a plurality of LEDS fixedly mounted on the surface, which would also be connected up to the battery powered unit and would blink randomly. As an option, the present invention would come with an incorporated clip attached to the bottom face of the battery compartment. The present invention could also contain an incorporated hinge fixedly mounted on the bottom face of the battery compartment, which would allow the present invention to be placed on a roadside in an upright position.

9 Claims, 4 Drawing Sheets

PORTABLE SAFETY DEVICE

BACKGROUND OF THE INVENTION

The present invention is that of a newly designed night time safety device for use by bicyclists, skateboarders, joggers, or other outside enthusiasts.

DESCRIPTION OF THE PRIOR ART

There are a wide variety of devices for people to wear in the prior art that will protect them at night time. One example is U.S. Pat. No. 5,743,621, issued to Mantha et al., which discloses an illuminated safety helmet that includes a pair of LED modules that are mounted at the front and back of the helmet and arranged in an electrical circuit with an onboard battery.

Another example is U.S. Pat. No. 5,738,431, issued to Lary, which discloses a common baseball type hat or headband to which is attached a single tubular halogen light apparatus or an apparatus containing several halogen lights positioned in a wide configuration.

U.S. Pat. No. 5,676,449, issued to Newsome, discloses a head covering and lamp system with improved adjustment capabilities and increased safety and also includes an adjustably supporting high intensity lamp over the bill of a visor.

U.S. Pat. No. 5,559,680, issued to Tabanera, discloses a bicycle helmet which includes an electroluminescent lamp film located between the liner and shell and positioned to emit light from the transparent window, a battery and an inverter.

U.S. Pat. No. 5,386,592, issued to Checkeroski, discloses a headband and flashlight holding construction that includes a plurality of equal length straps.

U.S. Pat. No. 4,891,736, issued to Gouda, discloses a signal helmet with a lens whose surface is flush with the surrounding surface in close proximity to the lens. Three signal lights shine through and about the lens for giving tail, brake, and directional indications to follow motorists at eye level of the following motorists.

As can be seen from the prior art, all the existing inventions are fixedly mounted to a type of a helmet or hat, and are not removable. Further, none of the prior art is mountable in a wide variety of ways similar to the present invention.

SUMMARY OF THE INVENTION

The present invention would be a small plastic enclosure having incorporated circuitry and a series of light emitting diodes (LEDS) covered by a plastic lens. The present invention would be designed so that the lights would blink in a random pattern so as to attract attention at night. The lights would be battery powered, and the batteries would be housed in a plastic battery compartment located immediately under the small plastic enclosure. An on/off switch would be attached to the outside of the battery compartment and would control power being transferred from the batteries to the lights. In addition, a pair of fastening elements would be attached to the side surfaces of the battery compartment in order to assist in securing the battery compartment to the top of a helmet or hat, if so desired. Each of the fastening elements would also contain a plurality of LED'S fixedly mounted on the surface, which would also be connected to the battery powered unit and would blink randomly. In addition to the fastening elements, the present invention would be attached to a bicycle helmet by incorporated hook and pile fastener straps located on the bottom face of the battery compartment and the top face of a bicycle helmet.

As an option, the present invention would come in a "walker's version" which would have an incorporated clip attached to the bottom face of the battery compartment. The incorporated clip would allow the present invention to be attached to a belt or an article of clothing. In another alternative version, termed the "motorist version", the present invention would contain a incorporated hinge fixedly mounted on the bottom face of the battery compartment, which would allow the present invention to be placed on a roadside in an upright position.

It is therefore an object of the present invention to provide a new and improved night time safety device.

It is therefore an object of the present invention to provide a new and improved night time safety device that is removable mountable.

It is therefore an object of the present invention to provide a new and improved night time safety device that can be used for a wide variety of outdoor activities at night.

It is therefore an object of the present invention to provide a new and improved night time safety device that is readily visible.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
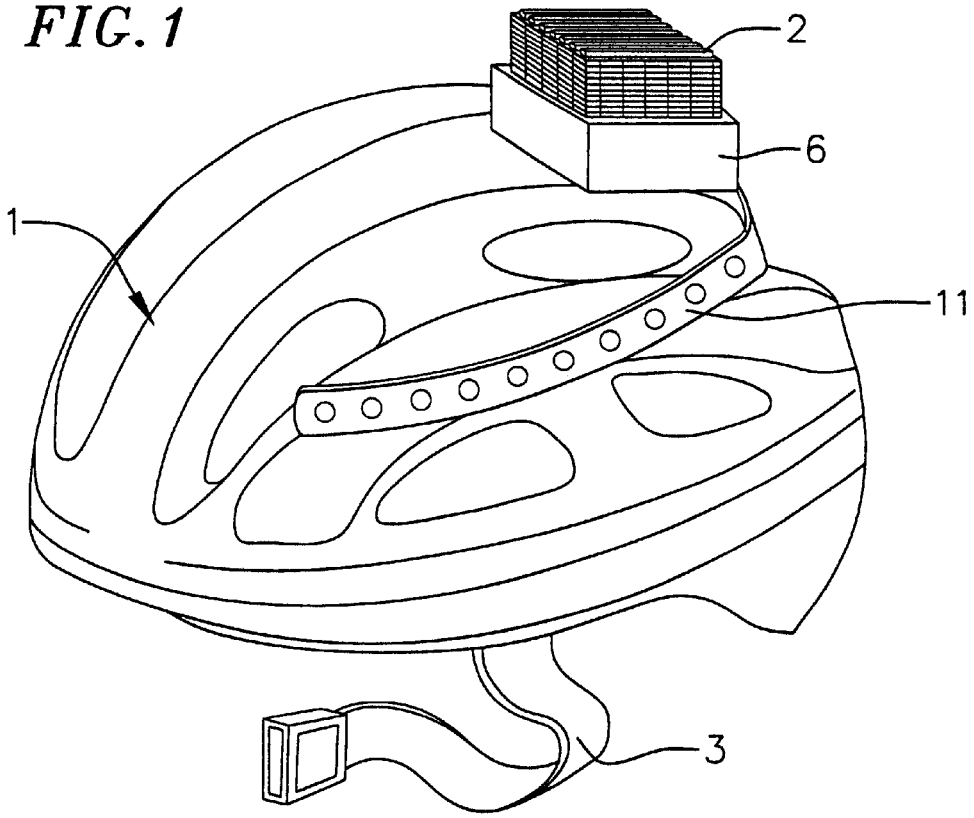
FIG. 1 shows a side view of the present invention, as mounted on a bicycle helmet.

Referring now to the drawings, FIG. 1 shows the LED lens 2 and battery compartment 6 as they would be seen fixedly attached to helmet 1, which contains strap 3. LED lens 2 and battery compartment 6 are held in place by fastening elements 10 and 11, which are attached to battery compartment 6.

Figure 2:
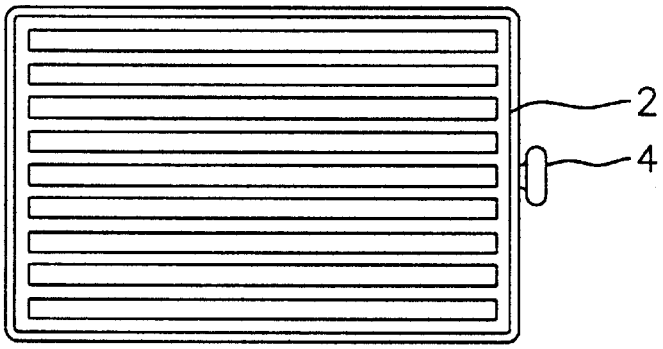
FIGS. 2, 3 and 4 show a top view, side view, and front view of the battery compartment and incorporated LED lens.
Figure 3:
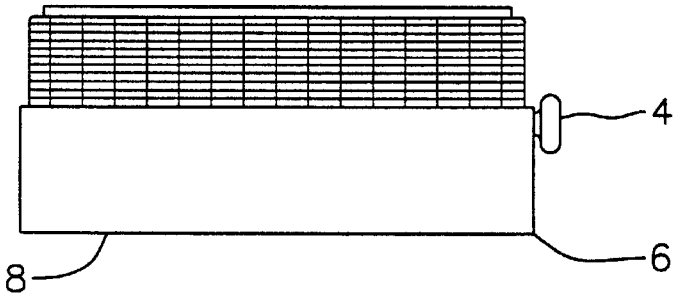
Figure 4:
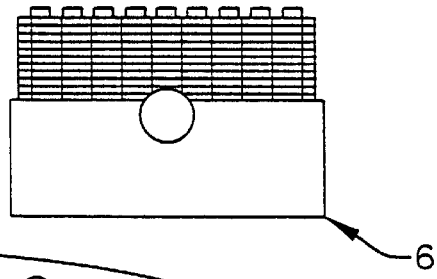

FIGS. 2, 3, and 4 show a top view, side view, and front view, respectively, of the combination of LED lens 2 and battery compartment 6. Battery compartment 6 is rectangularly shaped and has a top face, a bottom face, two side faces, a front end, and a rear end. The top face of battery compartment 6 includes a plurality of receptacles in which a user could place a plurality of LED lights 13. Battery compartment 6 would be designed to hold at least one battery and would be electronically connected to the plurality of receptacles located in the top face of battery compartment 6.

Battery compartment 6 also includes on-off switch 4, which is mounted on the front face of battery compartment 6 and controls the flow of power from battery compartment 6 to the plurality of LED lights 13 removably attached to the top surface of battery compartment 6. When on/off switch 4 would be in the "on" position, the plurality of lights would be designed to blink in a random pattern so as to attract attention at night.

Battery compartment 6 also includes hook and pile fastener 8 mounted on the bottom face of battery compartment 6. Hook and pile fastener 8 would assist a user by securing battery compartment 6 to the top of helmet 1 when the present invention would be in use with a bicycle helmet. Hook and pile fastener would be attached to the top of helmet 1 in various places so that battery compartment 6 could be properly affixed to helmet 1.

Figure 5:
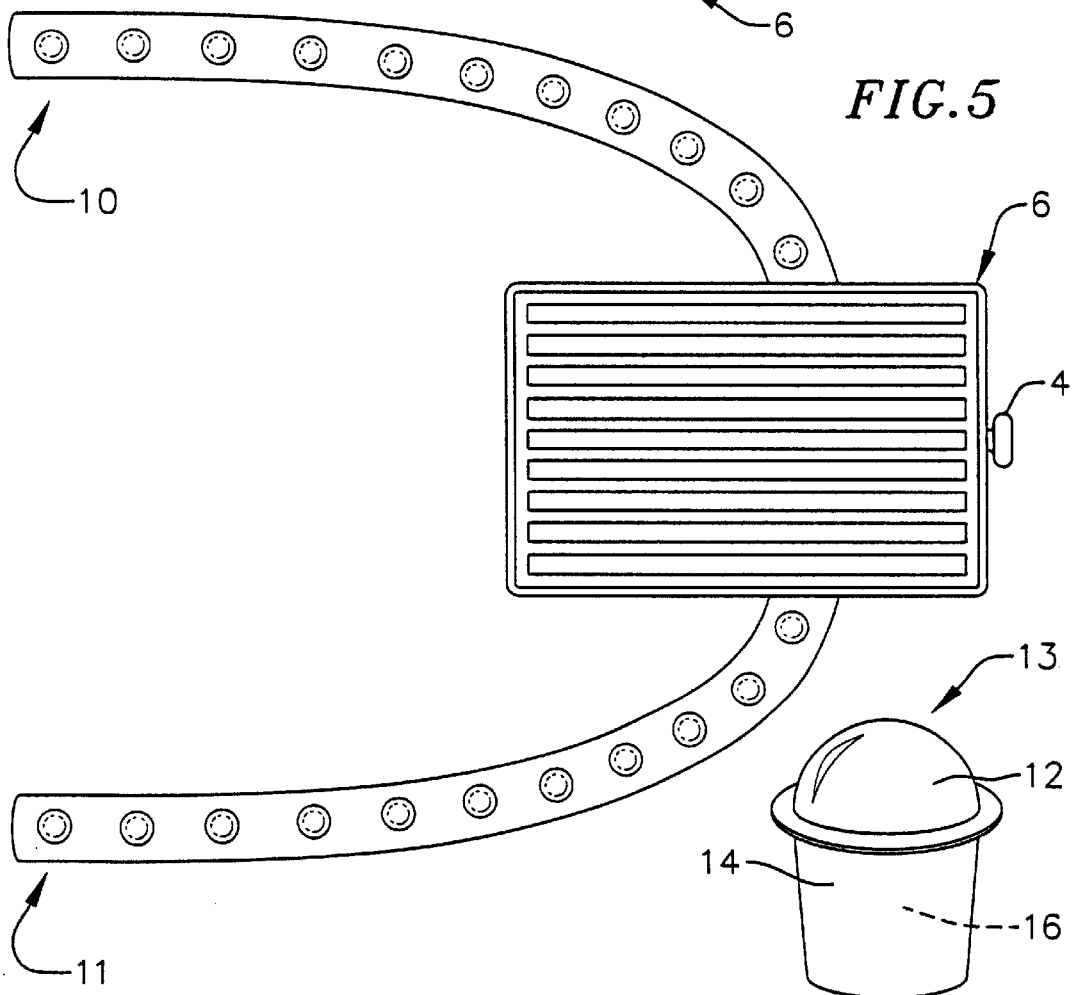
FIG. 5 shows a top view of the battery compartment with the incorporated fastening elements.

FIG. 5 shows a top view of battery compartment 6, also showing fastening elements 10 and 11 attached to the two side faces of battery compartment 6. The connection points between fastening elements 10 and battery compartment 6 and fastening element 11 and battery compartment 6 are designed to have a small amount of flexibility, allowing fastening elements 10 and 11 to be attached to a wide variety of sizes of helmet 1. The distance between fastening elements 10 and 11 is designed to be smaller than the width of most bicycle helmets in order to insure that fastening elements 10 and 11 would provide secure pressure against the sides of a helmet 1 that would be used with the present invention.

Fastening elements 10 and 11 each have a top face and a bottom face. The top face of both fastening element 10 and fastening element 11 contain a plurality of LED lights which are also electronically connected to the battery compartment of the present invention. On/off switch 4, when turned to the "on" position, also allows the LED lights on fastening elements 10 and 11 to randomly blink when a battery is in the battery compartment 6.

Figure 6:
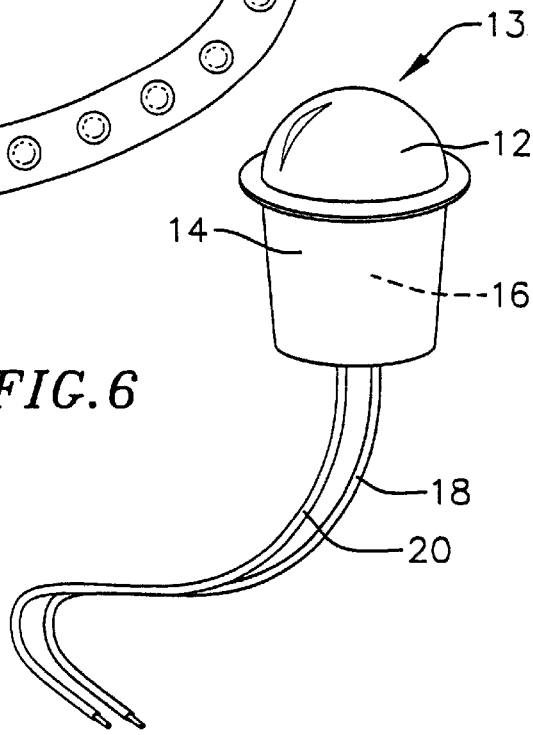
FIG. 6 shows a closeup side view of a single LED light.
Figure 7:
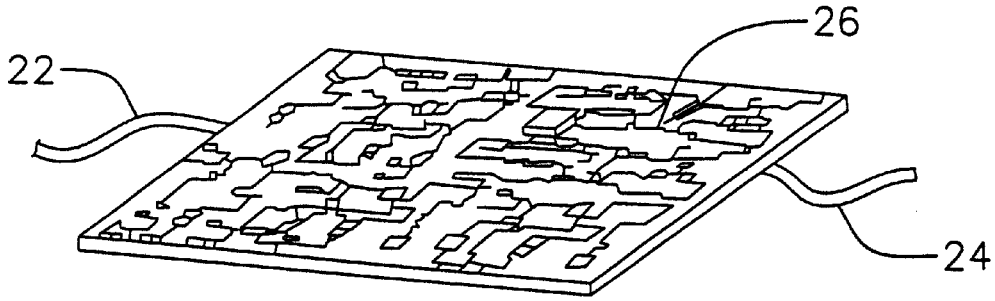
FIG. 7 shows a perspective view of the circuit board in the present invention.

FIG. 6 shows a closeup side view of a single LED light 13, which includes light 16, lens 12, casing 14 and wires 18 and 20. The invention would include a plurality of LED lights 13 removably mounted to the top face of battery compartment 6 and also mounted to the top face of fastening elements 10 and 11. Wires 18 and 20 are electronically connected to circuit board 26, which is shown in FIG. 7. Circuit board 26 also includes incorporated wires 22 and 24.

Figure 8:
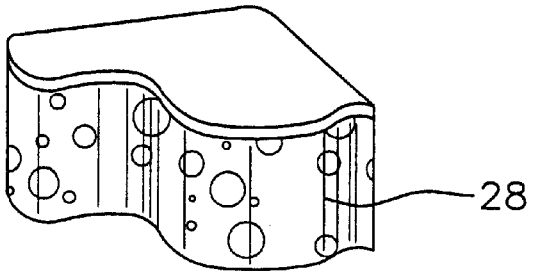
FIG. 8 shows a side view of the foam element of the bicycle helmet in the present invention.

FIG. 8 is a cross section of helmet 1, showing foam 28, which is a high density injected foam. Foam 28 serves to provide protection to the head of a user if he or she should get into an accident.

Figure 9:
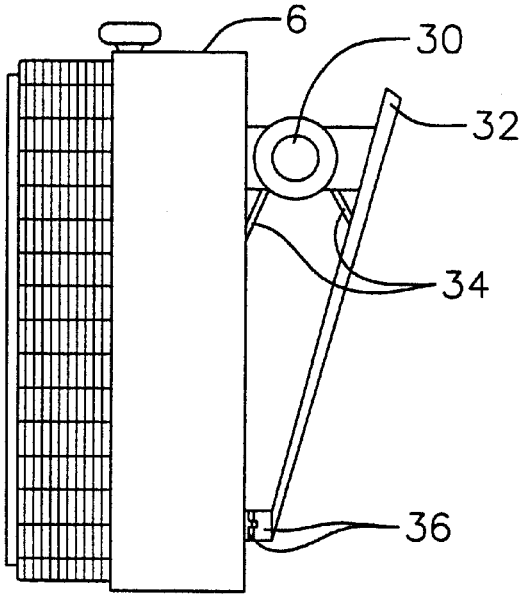
FIG. 9 shows a side view of the optional clip which would be attached to the bottom face of the battery compartment in the present invention.

FIG. 9 is a side view of the optional clip which is pivotly attached to the bottom face of battery compartment 6. The optional clip concludes hinge/pivot 30, hairpin type spring plastic clip 32, spring 34, and clip contact pad 36. Clip 32 is pivotly attached to hinge/pivot 30 and when not in use, rests against clip contact pad 36. Hinge/pivot 30 causes clip 32 to rest forcefully against clip contact pad 36. To successfully attach battery compartment 6 to a belt loop, pant seam, or other object, a user would force the belt loop, pant seam, or other object between clip contact pad 36 and the tip of clip 32, whereby the tip of clip 32 would still exert pressure against clip contact pad 36, effectively holding the product in place.

Figure 10:
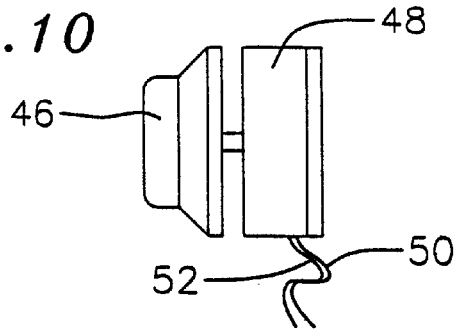
FIG. 10 shows a side view of the on/off switch of the present invention.

FIG. 10 shows a side view of on/off switch 4, which includes knob 46, switch assembly 48, and switch wires 50 and 52. On/off switch 4 controls the flow of power between the batteries within battery compartment 6 and the plurality of LED lights 13 removably attached to the top face of battery compartment 6.

Figure 11:
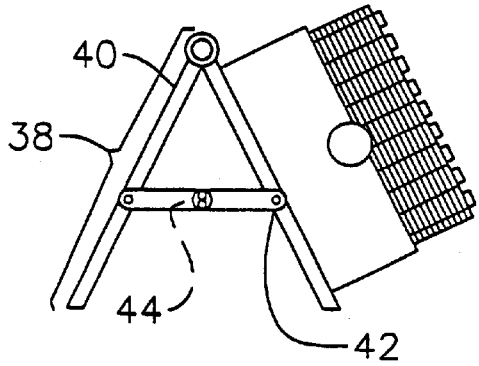
FIG. 11 shows a side view of the optional roadside hinge in the "motorist's version" in the present invention.

FIG. 11 shows a side view of the optional roadside hinge 38, which includes first leg 40, second leg 42, and cross arm 44. Second leg 42 is fixedly attached to the bottom face of battery compartment 6, while first leg 40 is pivotly attached to second leg 42. Cross arm 44 connects first leg 40 to second leg 42 and provides a maximum length of extension that will occur between first leg 40 and second leg 42.

Figure 12:
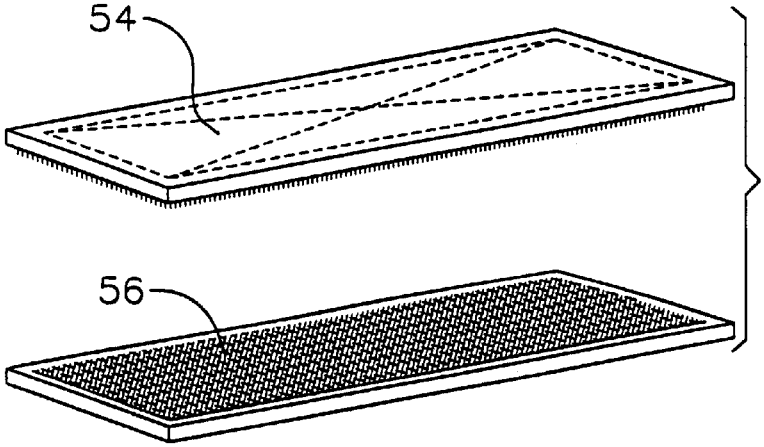
FIG. 12 shows a side perspective view of the incorporated hook and pile fastener located both on the helmet of the present invention and located on the bottom surface of the fastening elements of the present invention.

FIG. 12 shows one element of a hook and pile fastener 54 and a mating element of a hook and pile fastener 56. One element of a hook and pile fastener 54 is fixedly attached to the bottom surface of fastening elements 10 and 11, while a mating element of a hook and pile fastener 56 would be fixedly attached in the corresponding position on top of helmet 1.

Figure 13:
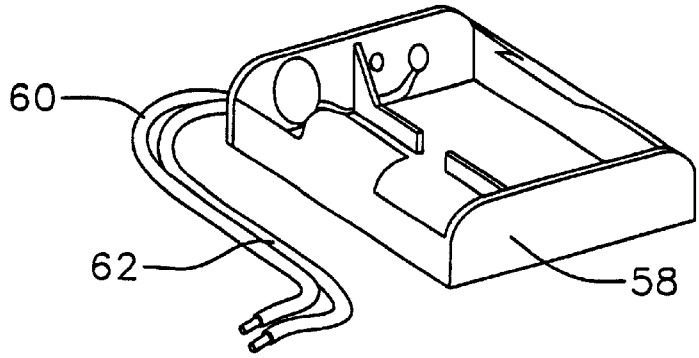
FIG. 13 shows a perspective view of the battery holder, which is located in the battery compartment of the present invention.

FIG. 13 shows a perspective view of battery holder case 58 and associated wires 60 and 62, which are located within battery compartment 6. At least one battery would be located within battery holder case 58 in order to provide adequate power to the present invention.

What I claim as my invention is:

1. A portable safety light securable to an object comprising:

a casing;

a power supply disposed inside said casing:

fastening elements secured to said casing, said fastening elements removably engaging said casing to said object;

a plurality of light emitting diodes, the light emitting diodes electrically connected to said power supply, said light emitting diodes mounted to said casing and mounted to said fastening elements;

a controller comprising a circuit board electrically connected to said light emitting diodes, the controller controlling the flow of power to each of said light emitting diodes to intermittently illuminate and extinguish said light emitting diodes; and a switch electrically connected to the power supply actuating the flow of power from the power supply to the controller.

2. The portable safety light of claim 1 further comprising a clip mounted to said casing, the clip comprising:

a hinge pivot mounted to said casing;

a hairpin clip pivotally attached to said hinge pivot;

a contact pad mounted to said casing spaced from said hinge pivot; and a spring biased to urge said hairpin clip into contact with said contact pad.

3. The portable safety light of claim 1 further comprising:

a leg having two ends pivotally attached to said casing proximate one end; and a foldable cross arm having two ends, one of said ends pivotally attached to said casing and the opposite end pivotally attached to said leg, the cross arm movable between a substantially straight configuration when said leg is pivoted away from the casing and a substantially folded position when said leg is pivoted toward the casing.

4. A portable safety light securable to an object comprising:

a casing;

a power supply disposed inside said casing;

flexible fastening elements attached to, and extending from, said casing, said flexible fastening elements engaging said casing to said object;

a plurality of light emitting diodes, the light emitting diodes electrically connected to said power supply, said light emitting diodes mounted to said casing and mounted to said flexible fastening elements;

a controller comprising a circuit board electrically connected to said light emitting diodes, the controller controlling the flow of power to each of said light emitting diodes to randomly illuminate or extinguish said light emitting diodes;

a switch electrically connected to the power supply actuating the flow of power from the power supply to the controller; and a cover secured to said casing over the light emitting diodes mounted to said casing.

5. The portable safety light of claim 4 further comprising a clip mounted to said casing, the clip comprising:

a hinge pivot mounted to said casing;

a hairpin clip pivotally attached to said hinge pivot;

a contact pad mounted to said casing spaced from said hinge pivot; and a spring biased to urge said hairpin clip into contact with said contact pad.

6. The portable safety light of claim 4 further comprising:

a leg having two ends pivotally attached to said casing proximate one end; and a foldable cross arm having two ends, one of said ends pivotally attached to said casing and the opposite end pivotally attached to said leg, the cross arm movable between a substantially straight configuration when said leg is pivoted away from the casing and a substantially folded position when said leg is pivoted toward the casing.

7. A portable safety light securable to an object, the object including one element of a hook and pile fastener secured to the surface thereof, comprising:

a casing;

a power supply disposed inside said casing;

the mating element of a flexible hook and pile fastener attached to, and extending from, said casing, said flexible fastener removably engaging said casing to said object;

a plurality of light emitting diodes, the light emitting diodes electrically connected to said power supply, said light emitting diodes mounted to said casing and mounted to said flexible fastener;

a controller comprising a circuit board electrically connected to said light emitting diodes, the controller controlling the flow of power to each of said light emitting diodes to randomly illuminate or extinguish said light emitting diodes;

a switch electrically connected to the power supply actuating the flow of power from the power supply to the controller; and a cover secured to said casing over the light emitting diodes mounted to said casing.

8. The portable safety light of claim 7 further comprising a clip mounted to said casing, the clip comprising:

a hinge pivot mounted to said casing;

a hairpin clip pivotally attached to said hinge pivot;

a contact pad mounted to said casing spaced from said hinge pivot; and a spring biased to urge said hairpin clip into contact with said contact pad.

9. The portable safety light of claim 7 further comprising:

a leg having two ends pivotally attached to said casing proximate one end; and a foldable cross arm having two ends, one of said ends pivotally attached to said casing and the opposite end pivotally attached to said leg, the cross arm movable between a substantially straight configuration when said leg is pivoted away from the casing and a substantially folded position when said leg is pivoted toward the casing.

* * * * *